US012735966B2

(12) United States Patent
Johnson

(10) Patent No.: US 12,735,966 B2
(45) Date of Patent: Sep. 15, 2026

(54) BOOSTING WELL PERFORMANCE IN GEOTHERMAL SYSTEMS

(71) Applicant: Schlumberger Technology Corporation, Sugar Land, TX (US)

(72) Inventor: Ashley Bernard Johnson, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/676,627

(22) Filed: May 29, 2024

(65) Prior Publication Data

US 2024/0401450 A1 Dec. 5, 2024

Related U.S. Application Data

(60) Provisional application No. 63/504,797, filed on May 30, 2023.

(51) Int. Cl.

| | |
|---|---|
| ***E21B 43/24*** | (2006.01) |
| ***E21B 43/248*** | (2006.01) |
| ***F24T 10/20*** | (2018.01) |

(52) U.S. Cl.

CPC ..... *E21B 43/2405* (2013.01); *E21B 43/248* (2013.01); *F24T 10/20* (2018.05)

(58) Field of Classification Search

CPC ..... E21B 43/2405; E21B 43/248; F24T 10/20
See application file for complete search history.

(56) References Cited

U.S. PATENT DOCUMENTS

| | | | |
|---|---|---|---|
| 2,896,718 | A | 7/1959 | Kibby |
| 3,642,068 | A | 2/1972 | Fitch |
| 3,878,884 | A | 4/1975 | Raleigh |
| 3,918,524 | A | 11/1975 | Broaddus |
| 4,047,569 | A | 9/1977 | Tagirov |

(Continued)

FOREIGN PATENT DOCUMENTS

| | | | |
|---|---|---|---|
| CN | 105840146 | A | 8/2016 |
| CN | 108756843 | A | 11/2018 |

(Continued)

OTHER PUBLICATIONS

Al-Nakhli, A. R., "Chemically-Induced Pressure Pulse: A New Fracturing Technology for Unconventional Reservoirs", SPE-172551-MS, presented at the SPE Middle East Oil Gas Show and Conference, Manama, Bahrain, 2015.

*Primary Examiner* — Neel Girish Patel
(74) *Attorney, Agent, or Firm* — Kyle R. Miiller

(57) ABSTRACT

Methods and systems are provided for extracting thermal energy from a conventional geothermal reservoir. One aspect involves drilling or accessing a production well that intersects the conventional geothermal reservoir, and detonating at least one linear shaped charge to enlarge or open a naturally-occurring fracture of the conventional geothermal reservoir at the intersection of the naturally-occurring fracture and the production well, which reduces pressures loss of fluid flow into the production well from the naturally-occurring fracture. The reduction in pressure loss can increase fluid flow into the production well to increase the amount of captured heat. The detonation of the linear shaped charge(s) can increase aperture size of at least one naturally-occurring fracture at a wellbore surface.

8 Claims, 12 Drawing Sheets

(56) References Cited

U.S. PATENT DOCUMENTS

| | | | | |
|---|---|---|---|---|
| 4,223,729 | A | 9/1980 | Foster | |
| 5,785,133 | A | 7/1998 | Murray | |
| 6,305,467 | B1 | 10/2001 | Connell | |
| 6,644,407 | B2 | 11/2003 | Arnold, III | |
| 7,828,063 | B2 | 11/2010 | Olsen | |
| 8,685,187 | B2 | 4/2014 | Han | |
| 8,820,075 | B2 * | 9/2014 | Kaminsky | F03G 4/074 60/641.2 |
| 9,217,321 | B2 | 12/2015 | Marvel | |
| 9,726,157 | B2 | 8/2017 | Sweatman | |
| 10,260,778 | B2 | 4/2019 | Sønju | |
| 10,551,091 | B2 | 2/2020 | Kruger | |
| 10,753,163 | B2 | 8/2020 | Dobkins | |
| 11,220,882 | B2 | 1/2022 | Nevison | |
| 11,434,740 | B1 * | 9/2022 | Ngyuen | E21B 43/26 |
| 11,473,410 | B1 * | 10/2022 | Batarseh | E21B 43/116 |
| 11,795,365 | B1 | 10/2023 | Nguyen | |
| 11,808,121 | B2 | 11/2023 | Norbeck | |
| 11,959,666 | B2 | 4/2024 | Fleckenstein | |
| 11,976,236 | B2 | 5/2024 | Evans | |
| 12,104,828 | B2 | 10/2024 | Geiser | |
| 12,258,945 | B2 | 3/2025 | Messner | |
| 12,292,212 | B2 | 5/2025 | Barree | |
| 12,298,043 | B1 | 5/2025 | Livescu | |
| 12,305,893 | B1 | 5/2025 | Alcantar | |
| 2004/0040707 | A1 | 3/2004 | Dusterhoft | |
| 2004/0262551 | A1 * | 12/2004 | Lam | E21B 33/062 251/1.3 |
| 2006/0102343 | A1 | 5/2006 | Skinner | |
| 2009/0242198 | A1 * | 10/2009 | Evans | E21B 43/119 175/4.51 |
| 2010/0032156 | A1 | 2/2010 | Petty | |
| 2010/0294494 | A1 | 11/2010 | Hefley | |
| 2010/0307756 | A1 | 12/2010 | Jung | |
| 2011/0234421 | A1 * | 9/2011 | Smith | H01B 3/004 340/854.3 |
| 2013/0292177 | A1 | 11/2013 | Meurer | |
| 2014/0262256 | A1 | 9/2014 | Zemach | |
| 2015/0204174 | A1 | 7/2015 | Kresse | |
| 2015/0233218 | A1 | 8/2015 | Myhre | |
| 2015/0275638 | A1 | 10/2015 | Wang | |
| 2015/0300327 | A1 * | 10/2015 | Sweatman | E21B 43/25 60/641.2 |
| 2017/0321934 | A1 | 11/2017 | Kruger | |
| 2018/0016895 | A1 | 1/2018 | Weng | |
| 2018/0080309 | A1 | 3/2018 | Althoff | |
| 2018/0202266 | A1 | 7/2018 | Holland | |
| 2018/0266225 | A1 | 9/2018 | Kemick | |
| 2019/0316455 | A1 * | 10/2019 | Surjaatmadja | E21B 43/1185 |
| 2020/0217181 | A1 * | 7/2020 | Norbeck | E21B 43/126 |
| 2020/0277528 | A1 * | 9/2020 | Taylor | C09K 8/74 |
| 2021/0363866 | A1 | 11/2021 | Al-Nakhli | |
| 2022/0325920 | A1 | 10/2022 | Barral | |
| 2023/0045716 | A1 | 2/2023 | Normann | |
| 2023/0064121 | A1 * | 3/2023 | Xia | E21B 43/119 |
| 2023/0083056 | A1 | 3/2023 | Acuna Cespedes | |
| 2023/0288099 | A1 | 9/2023 | Toews | |
| 2024/0035710 | A1 | 2/2024 | Toews | |
| 2024/0069238 | A1 | 2/2024 | Arshad | |
| 2024/0167731 | A1 | 5/2024 | Liang | |
| 2024/0280295 | A1 | 8/2024 | Olorode | |
| 2024/0401445 | A1 | 12/2024 | Khan | |
| 2024/0401572 | A1 | 12/2024 | Khan | |
| 2024/0418412 | A1 | 12/2024 | Barree | |
| 2025/0020052 | A1 | 1/2025 | Abuhaikal | |
| 2025/0109891 | A1 | 4/2025 | Johnson | |
| 2025/0290377 | A1 | 9/2025 | Hassig Fonseca | |

FOREIGN PATENT DOCUMENTS

| | | | |
|---|---|---|---|
| CN | 111043780 | A | 4/2020 |
| CN | 111520924 | A | 8/2020 |
| CN | 112012709 | A | 12/2020 |
| CN | 213898935 | U | 8/2021 |
| CN | 113863914 | A | 12/2021 |
| CN | 120043261 | A | 5/2025 |
| JP | 2015121093 | A | 7/2015 |
| WO | 2021078766 | A1 | 4/2021 |
| WO | 2022055947 | A1 | 3/2022 |

* cited by examiner

BOOSTING WELL PERFORMANCE IN GEOTHERMAL SYSTEMS

CROSS-REFERENCE TO RELATED APPLICATION(S)

The present disclosure claims priority from U.S. Prov. Appl. No. 63/504,797, filed on May 30, 2023, entitled "BOOSTING WELL PERFORMANCE IN GEOTHERMAL SYSTEMS," herein incorporated by reference in its entirety.

FIELD

The present disclosure relates to geothermal systems that extract thermal energy (heat) from a geothermal reservoir.

BACKGROUND

Geothermal systems that extract thermal energy (heat) from a geothermal reservoir are generating considerable interest. A conventional geothermal reservoir is a volume of subsurface rock that contains a natural source of pressurized hot water or brine which is used as a source of thermal energy (heat). One or more production wells are drilled from the surface into and through the conventional geothermal reservoir and intersect one or more naturally-occurring fractures (also commonly referred to as fissures) in the subsurface rock of the conventional geothermal reservoir. These naturally-occurring fractures provide a flow path of the pressurized hot water or brine into the production well(s) where it flows through the production well(s) to the surface. The thermal energy (heat) from the hot fluid that flows to the surface can be extracted and used by an energy conversion plant for power generation, large scale heating or cooling, industrial/agricultural processes, or other geothermal applications.

FIG. 1 illustrates an example geothermal system 101, which includes a conventional geothermal reservoir 109. A production well 103 is drilled from the surface 105 into and through the conventional geothermal reservoir 109 and intersects a naturally-occurring fracture 111 in the subsurface rock of the conventional geothermal reservoir 109. The naturally-occurring fracture 111 provides a flow path of the pressurized hot water or brine into the production well(s) as depicted by arrows 113, where it flows through the production well 103 to the surface 105. The thermal energy (heat) from the hot fluid that flows to the surface 105 can be extracted and used by an energy conversion plant for power generation, large scale heating or cooling, industrial/agricultural processes, or other geothermal applications. The wellbore of the production well 103 can be completed with a perforated casing 115 with perforations in the interval of the production well 103 that intersects the naturally-occurring fracture 111. Alternatively, the wellbore of the production well 103 can be completed with a perforated liner or as an open wellbore at least in the interval of the production well 103 that intersects the naturally-occurring fracture 111.

There can be significant flow pressure loss where the naturally-occurring fracture 111 intersects and fluidly couples to the production well 103. Specifically, the aperture of a naturally-occurring fracture 111 at the intersection of the production well 103 can act as a flow restrictor that limits fluid flow through the naturally-occurring fracture 111 and into the production well 103. This can limit the amount of heat captured by the system and delivered to the surface and thus decrease the productivity of the system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Methods and systems for extracting thermal energy from a conventional geothermal reservoir are disclosed. The conventional geothermal reservoir has at least one naturally-occurring fracture that extends through the conventional geothermal reservoir. A production well can be drilled or accessed whereby the production well intersects the at least one naturally-occurring fracture. The at least one naturally-occurring fracture provides a flow path of pressurized hot water or brine into the production well. Well log data can be analyzed to determine a position or depth of the at least one naturally-occurring fracture in the production well. One or more linear shaped charges can be detonated in the production well at a position or depth that corresponds to the position or depth of the at least one naturally-occurring fracture. The detonation of the linear shaped charge(s) can be configured to enlarge or open the naturally-occurring fracture at the intersection of the naturally-occurring fracture and the production well to reduce pressure loss and increase the flow rate of pressurized hot water or brine carried by the naturally-occurring fracture into the production well. The method can be performed on multiple naturally-occurring fractures that connect to the production well. The method can also be applied to multiple production wells that intersect the conventional geothermal reservoir.

In embodiments, the reduction in pressure loss and increase in the flow rate of pressurized hot water or brine carried by the naturally-occurring fracture into the production well can increase the amount of heat captured by the system.

In embodiments, the detonation of the linear shaped charge(s) can increase the aperture size of at least one naturally-occurring fracture at a wellbore surface.

In embodiments, the linear shaped charge(s) can be positioned in the production well such that the penetration pattern of the linear shaped charge(s) that results from detonation intersects the at least one naturally-occurring fracture.

In embodiments, the linear shaped charge(s) can be supported by a downhole tool. The position of the downhole tool can be aligned to the position of the at least one naturally-occurring fracture derived from well log data such that the penetration pattern of the linear shaped charge(s) that results from detonation intersects the at least one naturally-occurring fracture.

In embodiments, the position of the downhole tool as well as the position of the at least one naturally-occurring fracture can be defined in a reference coordinate system, such as a reference coordinate system that includes well depth and azimuth angle.

In embodiments, the downhole tool can have a central axis, and the linear shaped charge(s) can be supported by the downhole tool in an orientation generally parallel to the central axis of the downhole tool.

In embodiments, the production well can be configured to carry a flow of heated fluid through the production well for delivery to the surface.

In other aspects, a method for extracting thermal energy from a geothermal reservoir involves drilling a production well that intersects the geothermal reservoir in two stages that include an upper stage and a lower stage. In the upper stage, the larger diameter wellbore is drilled from the surface or near the surface to an intermediate depth. In the lower stage, a smaller diameter wellbore is drilled below the intermediate depth to intersect the geothermal reservoir such that the smaller diameter wellbore of the lower stage extends below the larger diameter wellbore of the upper stage to the geothermal reservoir.

In embodiments, the production well can carry a flow of heated fluid through the production well for delivery to the surface.

In embodiments, the geothermal reservoir can be a conventional geothermal reservoir that includes at least one naturally-occurring fracture that carries a flow of pressurized hot water or brine into the lower stage of the production well.

In other embodiments, the geothermal reservoir can be a non-conventional geothermal reservoir that provides a source of pressurized hot fluid that flows into the lower stage of the production well.

In another aspect, a method for extracting thermal energy from a geothermal reservoir involves drilling a secondary production well to intersect a primary production well at a point above the geothermal reservoir.

In embodiments, both the primary production well and the secondary production well can carry a flow of heated fluid therethrough for delivery to the surface.

In embodiments, heated fluid can flow from the geothermal reservoir up the primary production well to the point of intersection, and then flow up both the primary and secondary production wells from that point of intersection.

In embodiments, the geothermal reservoir can be a conventional geothermal reservoir that includes at least one naturally-occurring fracture that carries a flow of pressurized hot water or brine into the primary production well below the point of intersection of the primary and secondary production wells.

In other embodiments, the geothermal reservoir can be a non-conventional geothermal reservoir that provides a source of pressurized hot fluid that flows into the primary production well below the point of intersection of the primary and secondary production wells.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Embodiments of the present disclosure are directed to boosting or improving the performance of geothermal systems that include a conventional geothermal reservoir, which is a volume of subsurface rock that contains a natural source of pressurized hot water or brine. One or more production wells are drilled from the surface into and through the conventional geothermal reservoir and intersect one or more naturally-occurring fractures in the subsurface rock of the conventional geothermal reservoir. These naturally-occurring fractures provide a flow path of the pressurized hot water or brine into the production well(s) where it flows through the production well(s) to the surface. The thermal energy (heat) from the hot fluid that flows to the surface can be extracted and used by an energy conversion plant for power generation, large scale heating or cooling, industrial/agricultural processes, or other geothermal applications.

Figure 2:
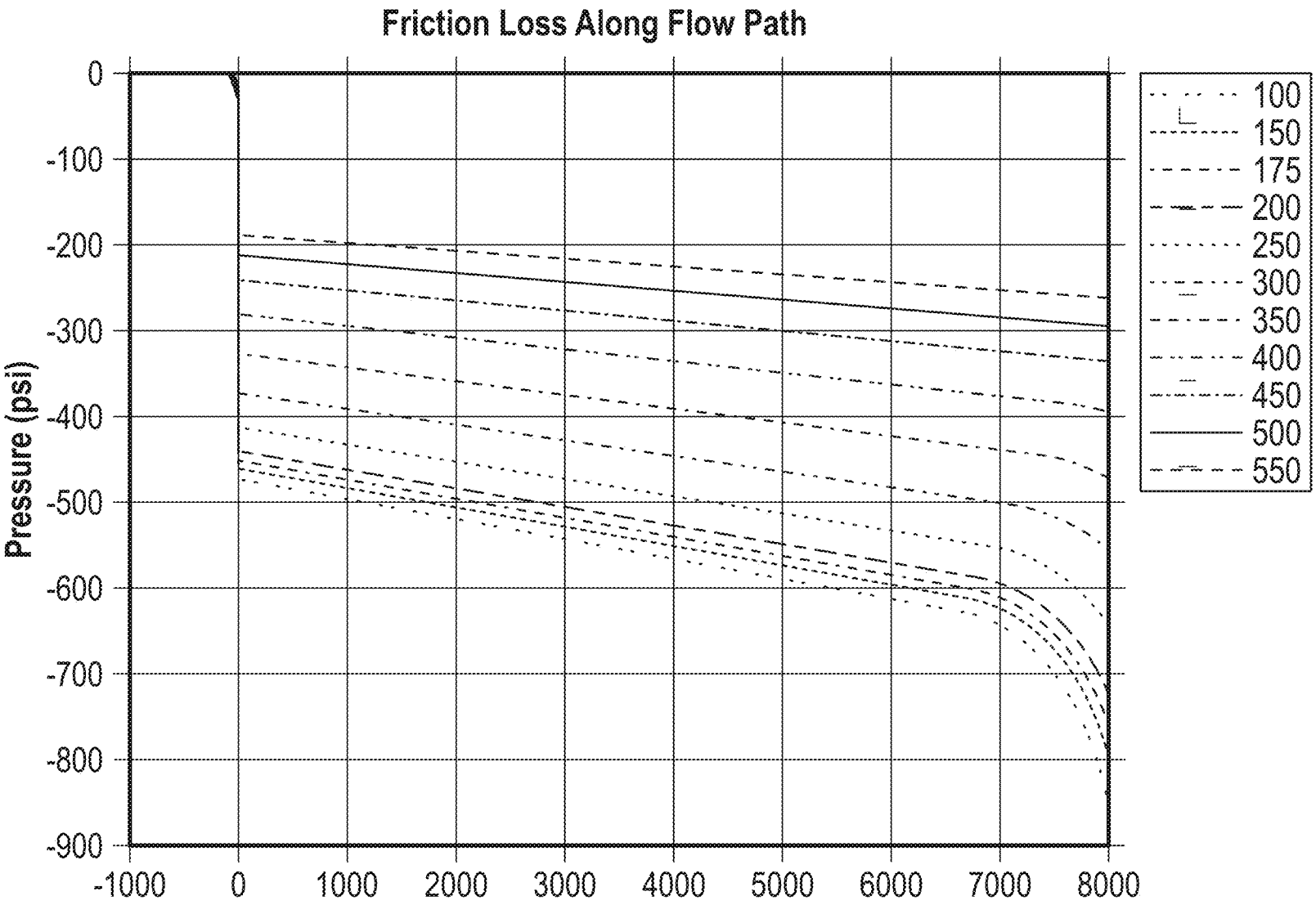
FIG. 2 depicts plots of pressure loss (loss of pressure head) along a flow path from a 3 mm fracture that extends through a conventional geothermal reservoir and up a production well to the surface of a geothermal system. The plots of pressure loss are labeled for varying surface pressure applied at the surface wellhead in the range from 100 to 550 psi.

Flow loss can occur where the naturally-occurring fracture intersects and fluidly couples to the production well of the system. Specifically, the aperture of a naturally-occurring fracture at the intersection of the production well can act as a flow restrictor that limits fluid flow through the fracture and into the production well. This can limit the amount of heat captured by the system and delivered to the surface and thus decrease the productivity of the system. These pressure losses are illustrated in FIG. 2, which includes plots of pressure loss (loss of pressure head) along a flow path from a 3 mm naturally-occurring fracture and up a production well to the surface of a geothermal system. The pressure loss along the flow path is from the far field through the 3 mm fracture that enters the production well (at x=0) and flows to the surface (at x=8000). The plots of pressure loss are labeled for varying surface pressure applied at the surface wellhead in the range from 100 to 550 psi. The plots of FIG. 2 are derived from simulations, which assume that the naturally-occurring fracture is defined by a flat and parallel disc that surrounds the production well with radial inflow. In this case, the aperture of the naturally-occurring fracture forms an annular void of a well-defined height (in this case 3 mm) that encircles the production well with the circumference of the annular void corresponding to the wellbore diameter. The flow through the naturally-occurring fracture is assumed to be laminar flow that transitions to turbulent flow with the transition at the point where the laminar and turbulent friction factors are equal. The far field is assumed to be at a constant pressure source. The actual pressure drop for the laminar flow is minimal. The pressure drop for the turbulent flow is higher as evidenced by the plot. The bigger pressure drop is at the entrance (intersection) of the naturally-occurring fracture into the production well.

According to one or more embodiments of the present disclosure, one or more downhole tools can be configured to position and detonate one or more linear shaped charges in a production well of a geothermal system to enlarge or open a naturally-occurring fracture at the intersection of the naturally-occurring fracture and the production well to reduce pressure loss and increase the flow rate of pressurized hot water or brine carried by the naturally-occurring fracture into the production well. This can increase the amount of heat captured by the system and delivered to the surface and thus increase the productivity of the system. This can be performed on multiple naturally-occurring fractures that connect to the production well. This can also be applied to multiple production wells that intersect a conventional geothermal reservoir.

Figure 3:
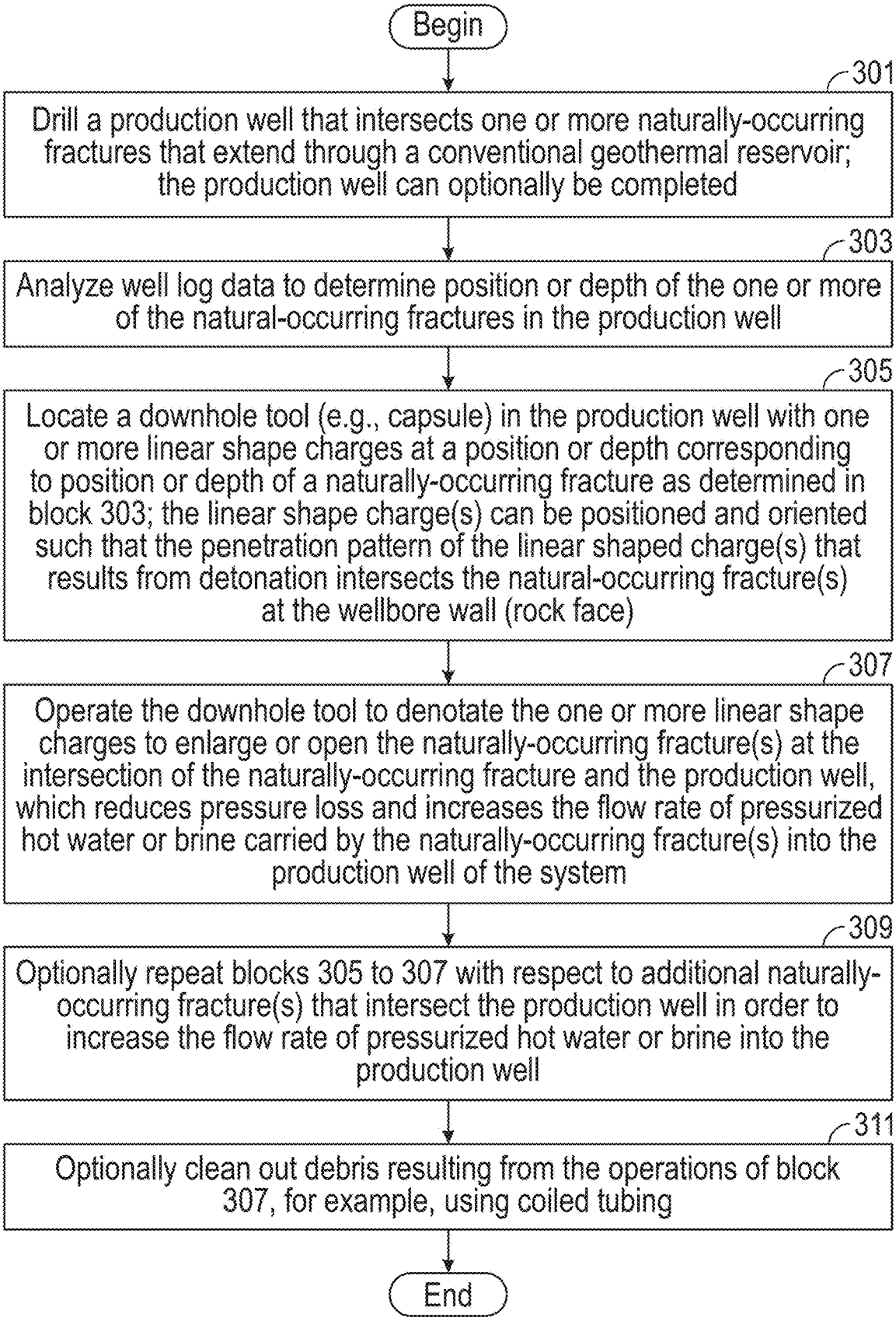
FIG. 3 depicts a flowchart of an example workflow that uses one or more linear shaped charges to enlarge the aperture of one or more naturally-occurring fractures that extend through a conventional geothermal reservoir and intersect a production well of a geothermal system.

FIG. 3 is a flowchart of an example workflow that uses one or more linear shaped charges to enlarge the aperture or connection of one or more naturally-occurring fractures that extend through a conventional geothermal reservoir and intersect a production well of a geothermal system.

Figure 1:
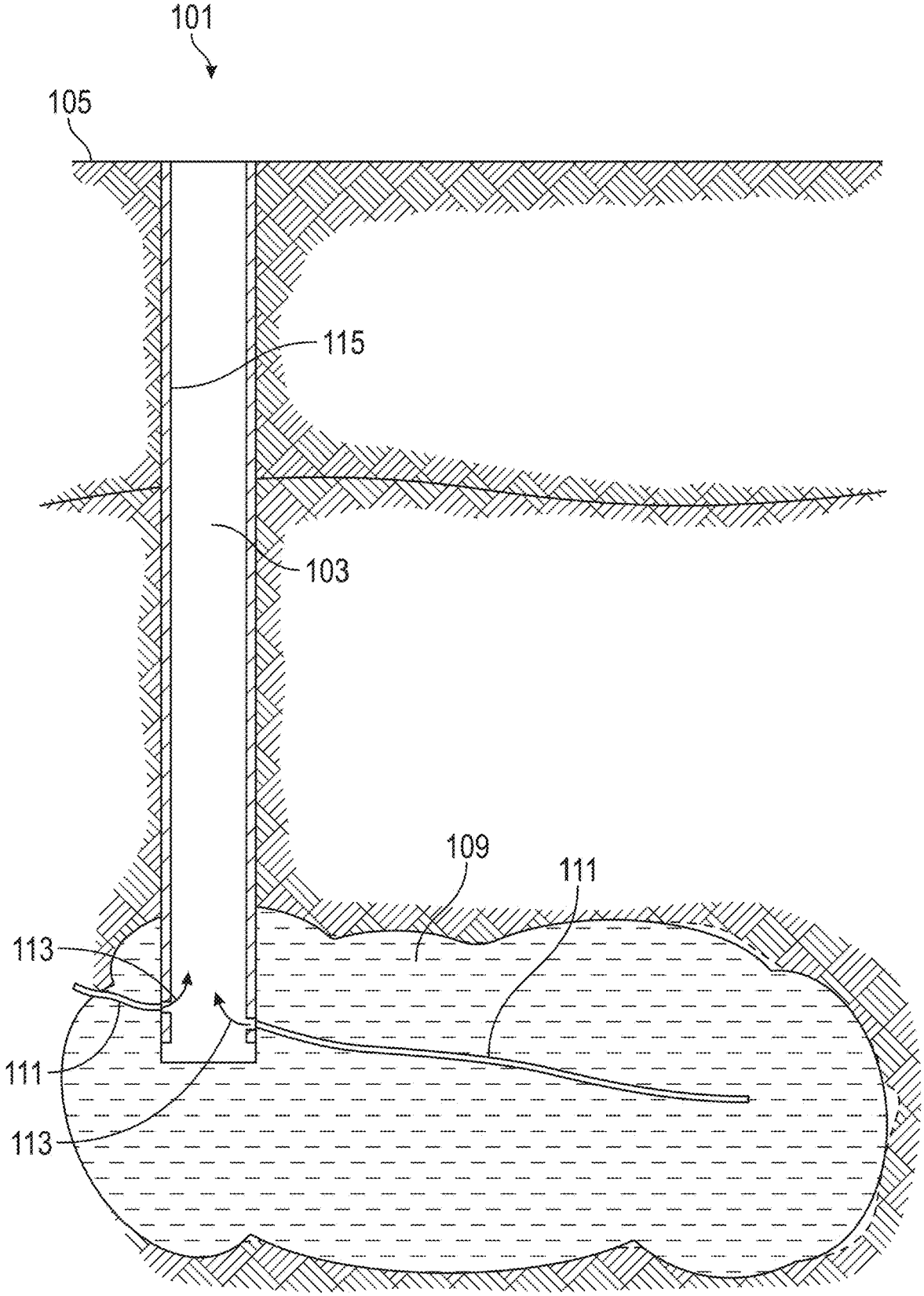
FIG. 1 is a schematic diagram of a geothermal system having a production well that intersects and connects to a naturally-occurring fracture extending through a conventional geothermal reservoir.

In block 301, a production well (also commonly referred to as a production wellbore) is drilled such that the production well intersects one or more naturally-occurring fractures of a conventional geothermal reservoir. The one or more naturally-occurring fractures extend through the conventional geothermal reservoir and connect to the production well. The one or more naturally-occurring fractures provide for fluid flow of the hot water or brine sourced from the conventional geothermal reservoir into the production well as shown in FIG. 1. Conventional or unconventional drilling methods can be used. In embodiments, the production well can optionally be completed, for example with a perforated casing or perforated liner as an open wellbore at least in the interval(s) that intersect the one or more naturally-occurring fractures of the conventional geothermal reservoir.

Figure 4:
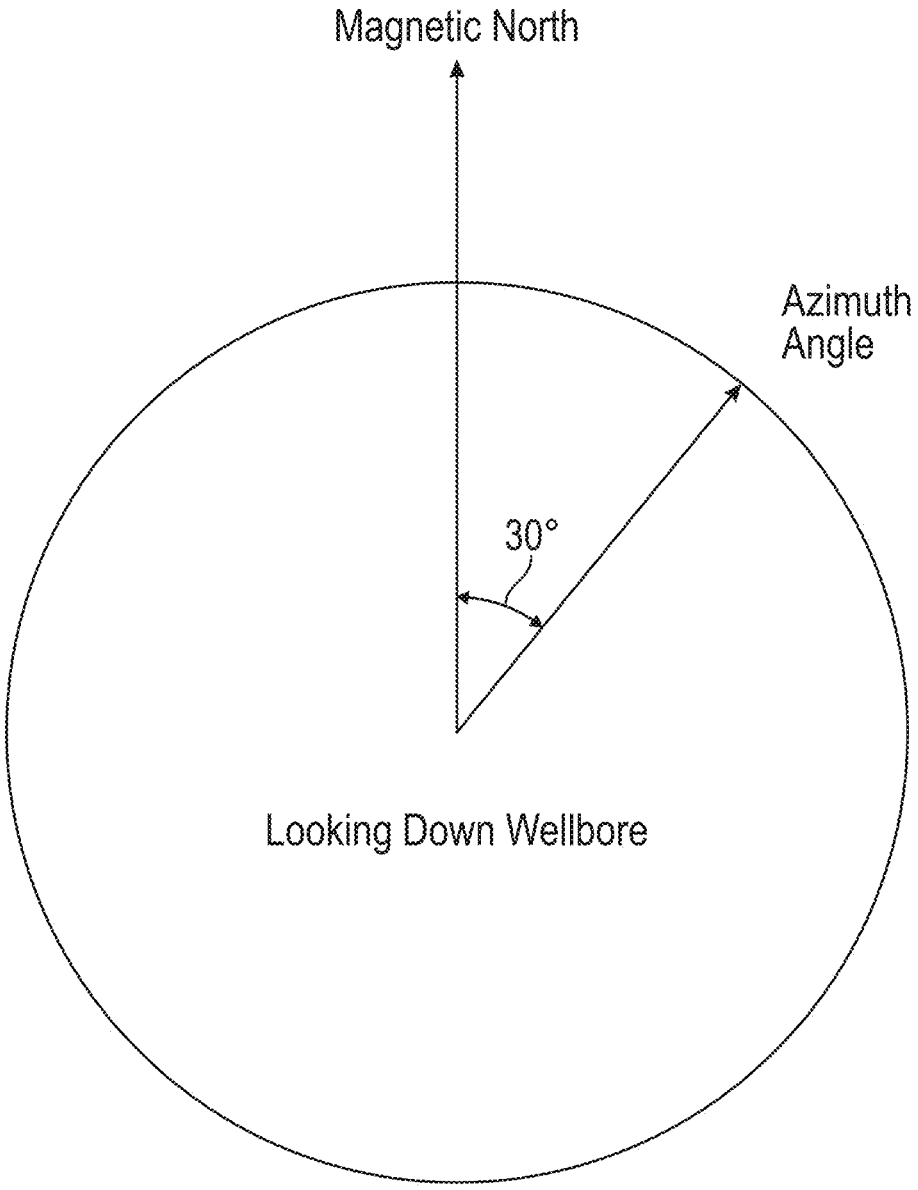
FIG. 4 depicts a reference coordinate system that employs wellbore depth and azimuth angle.

In block 303, well log data can be analyzed to determine the position or depth of one or more naturally-occurring fractures intersected by the production well of block 301. For example, borehole pressure measurements, caliper measurements, resistivity measurements, acoustic or ultrasonic borehole imaging measurements, and/or other downhole measurements can be analyzed to determine wellbore depth for one or more naturally-occurring fractures. These measurements can be performed while-drilling or by a wireline tool after drilling. For example, borehole pressure measurements can be analyzed for pressure loss while drilling. When the drilling crosses a naturally-occurring fracture, the borehole pressure will decrease. The depth of such pressure loss can be detected and used as the wellbore depth of the naturally-occurring fracture. FIG. 4 illustrates a reference coordinate system that employs wellbore depth, which corresponds to the depth looking down the production wellbore. The reference coordinate system also employs an azimuth angle, which is measured relative to magnetic north.

Figure 5:
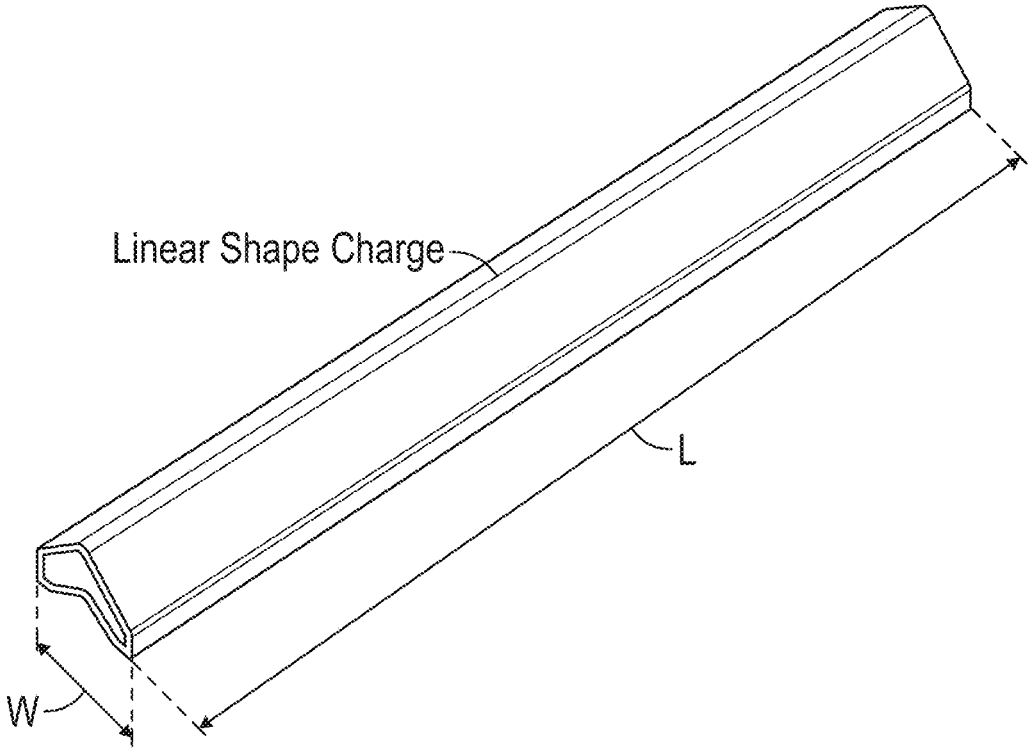
FIG. 5 depicts a linear shaped charge.

In block 305, a downhole tool (e.g., capsule gun) can be located in the production well of block 301 with one or more linear shape charges at a position (e.g., wellbore depth) corresponding to one or more naturally-occurring fractures characterized in block 303. The linear shaped charge is a continuous core of explosive material enclosed in an elongate narrow seamless metal sheath housing. The charge can be shaped in the form of an inverted "V" having a larger length (labeled "L") relative to a smaller width (labeled "W") as shown in FIG. 5, which allows the continuous metal sheath liner and encased explosive to produce a uniform linear cutting action upon detonation. The linear shape charge(s) can be positioned and oriented at a wellbore depth and azimuth angle such that the penetration pattern of the linear shaped charge(s) that results from detonation intersects the naturally-occurring fracture(s) at the wellbore wall (rock face) and enlarges the size of the aperture(s) of the naturally-occurring fracture(s) at the wellbore wall and reduces pressure loss of the fluid flow through the naturally-occurring fracture(s) at the wellbore wall (rock face).

In block 307, the downhole tool can be operated to detonate the linear shape charge(s). The penetration pattern of the linear shaped charge(s) that results from such detonation intersects one or more naturally-occurring fractures at the wellbore wall and enlarges or opens the naturally-occurring fracture(s) at the intersection of the naturally-occurring fracture(s) and the production well, which reduces pressure loss of the fluid flow through the naturally-occurring fracture(s) at the wellbore wall (rock face). This can increase the fluid flow through the naturally-occurring fracture(s) that connects to the production well of the system, which can increase the amount of heat captured by the system and delivered to the surface and thus increase the productivity of the system.

In embodiments, the aperture of a naturally-occurring fracture at the wellbore wall can have a larger width or circumference dimension relative to a smaller height dimension, such as in the shape of a flattened disc. In this configuration, the linear shaped charge can be configured such that the major length dimension (L) of the linear shaped charge(s) is larger than the minor height dimension of the naturally-occurring fracture with the minor width dimension (W) of the linear shaped charge(s) less than the major width or circumferential dimension of the naturally-occurring fracture. The linear shaped charge(s) can be positioned and oriented such that the major length dimension (L) of the linear shaped charge(s) extends in a direction generally orthogonal or across the minor height dimension of the naturally-occurring fracture with the minor width dimension (W) of the linear shaped charge(s) extending parallel or across a part of the major width or circumference dimension of the naturally-occurring fracture. In this configuration, the constraints on aligning the position and orientation of the linear shaped charge(s) with the aperture of the naturally-occurring fracture can be relaxed. This can reduce complexity and possibly errors in such alignment while permitting the detonation of the linear shaped charge(s) to provide a penetration pattern that intersects the naturally-occurring fracture and enlarges the size of the aperture of the naturally-occurring fracture at the wellbore wall and reduces pressure loss of the fluid flow through the naturally-occurring fracture at the wellbore wall (rock face).

In optional block 309, the operations of blocks 305 to 307 can be repeated with the same or additional downhole tools to locate and detonate additional linear shape charge(s) to reduce pressure loss of the fluid flow through other naturally-occurring fracture(s) that intersect the production well.

In optional block 311, debris resulting from the operation of 307 can be cleaned out and removed from the production well, for example, using coiled tubing. This can also increase the flow rate of pressurized hot water or brine into the production well.

Figure 6:
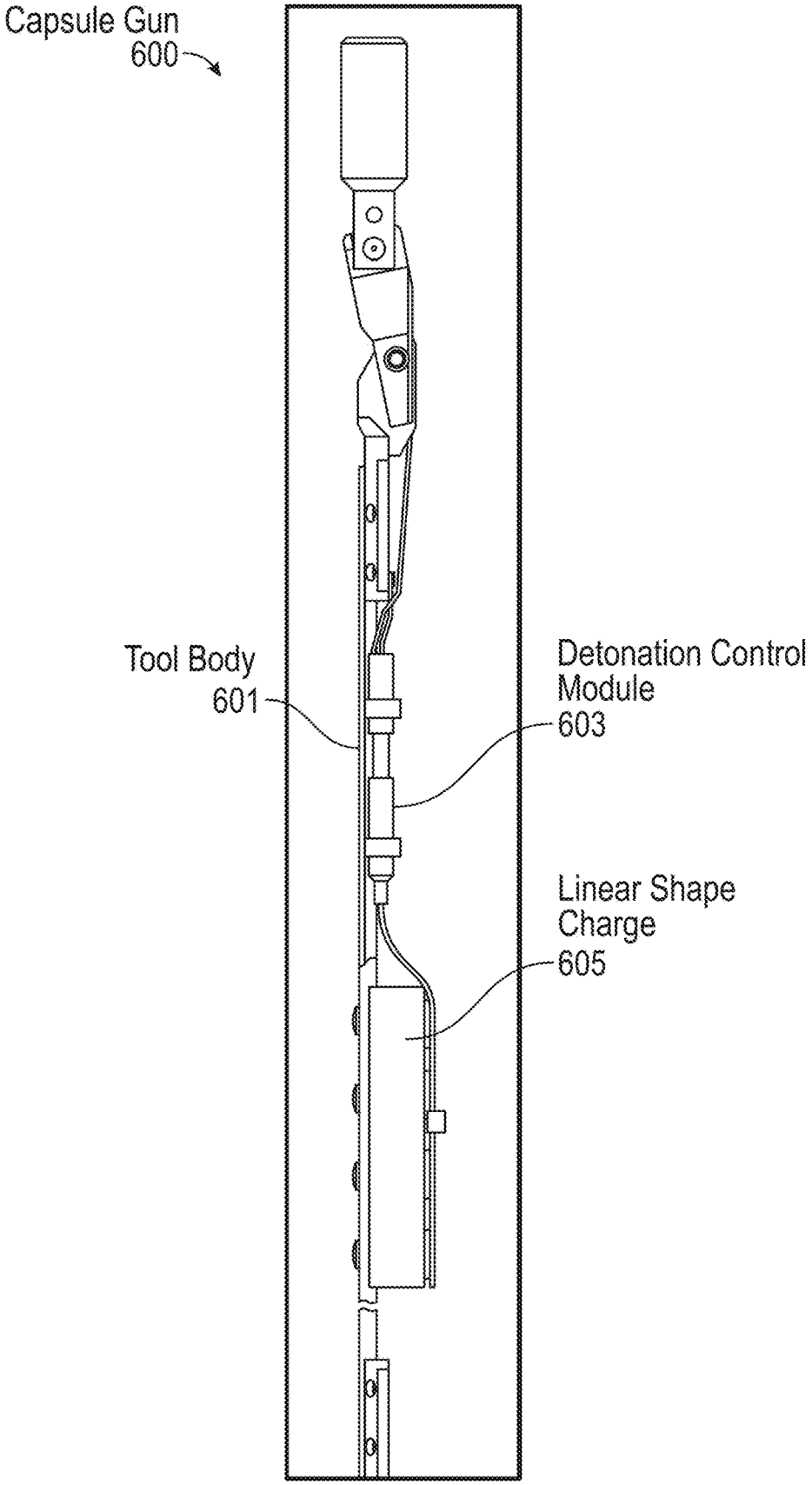
FIG. 6 depicts a downhole tool (e.g., labeled "capsule gun") that supports one or more linear shaped charges for deployment in a well for controlled detonation of the linear shaped charge(s) in the well.

FIG. 6 illustrates a downhole tool (e.g., labeled "capsule gun") 600 that can be used as part of the workflow of FIG. 3. Specifically, the capsule gun includes a tool body 601 that can be conveyed in the production well by coiled tubing, wireline cable or other conveyance means. The tool body 601 supports a detonation control module 603 and one or more linear shaped charges (one shown as 605). The detonation control module 603 is operably coupled to the linear shaped charge(s) 605 and can be remotely controlled from the surface to activate the detonation of the linear shaped charge(s) 605. The position and orientation (e.g., wellbore depth and azimuth angle) of the capsule gun 600 can be set such that the linear shape charge(s) are positioned and oriented in the production well at a desired depth and azimuth angle in the well such that the penetration pattern of the linear shaped charge(s) that results from detonation intersects the naturally-occurring fracture(s) at the wellbore wall (rock face) as described herein. In some applications, the production well can be substantially vertical, and the naturally-occurring fracture(s) close to horizontal. In this case, the linear shape charge(s) 605 can be aligned parallel to the central axis of the tool body such that the slot-like penetration pattern of the linear shaped charge(s) that results from detonation intersects the naturally-occurring fracture(s) at the wellbore wall (rock face) and extends perpendicular to the naturally-occurring fracture(s).

Figure 7:
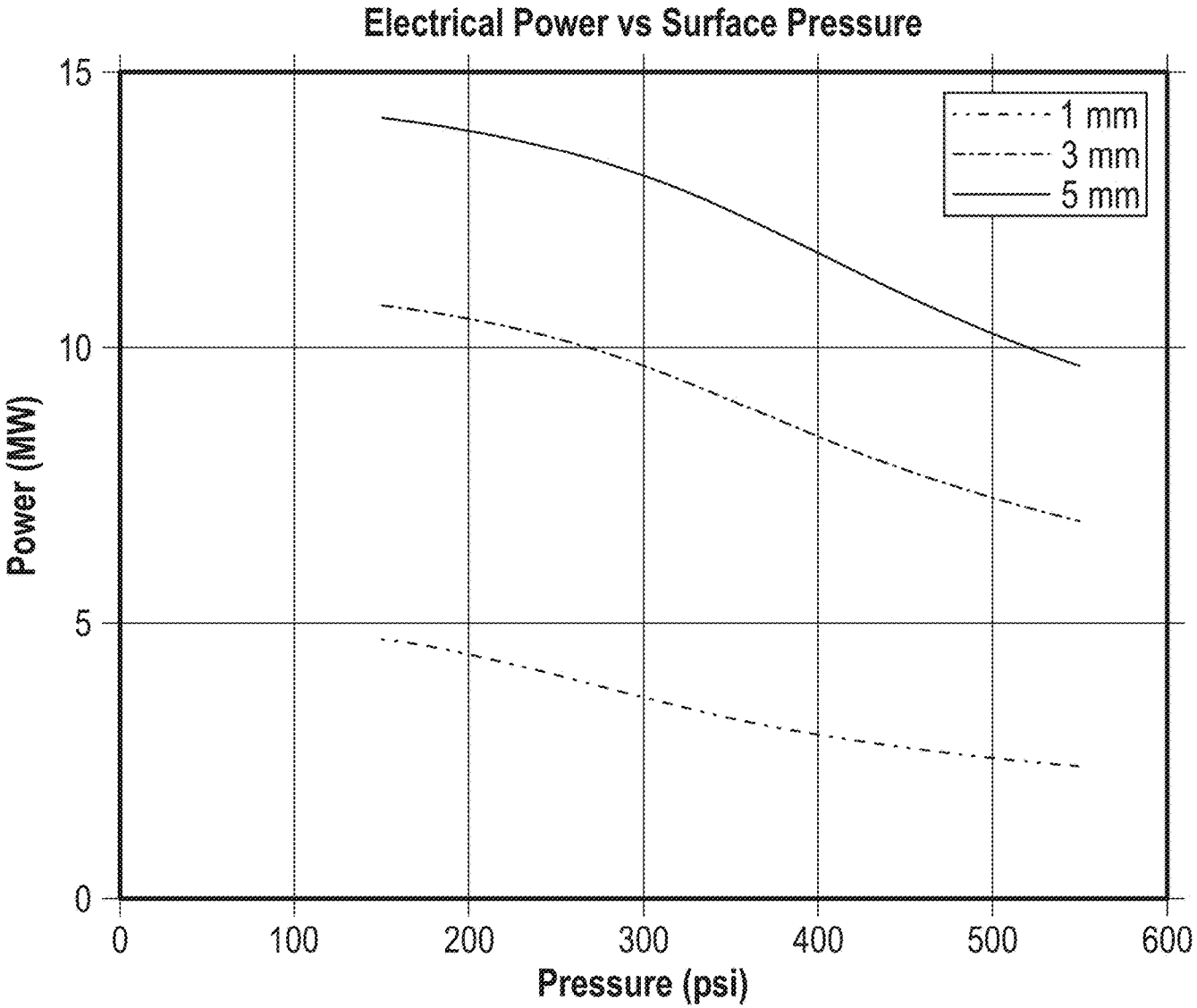
FIG. 7 depicts plots of available power extracted from a conventional geothermal reservoir with varying fracture aperture size in the range of 1 mm, 3 mm and 5 mm.

FIG. 7 includes plots of available power from a conventional geothermal reservoir with varying fracture aperture size in the range of 1 mm, 3 mm and 5 mm. Note that an increase in fracture aperture size from 1 mm to 3 mm results in an increase in performance. Similarly, an increase in fracture aperture size from 3 mm to 5 mm results in a further increase in performance, which is even more than the increase that results from the 1 mm to 3 mm increase in fracture aperture size. The plots of FIG. 7 are derived from simulations, which assume an 8.5 inch wellbore, and the same pressure/temperature at the far field. The fracture is modelled as a disc. The pressure loss in the actual fracture is small compared to that at the wellbore entry, as in FIG. 2. The well is flowed at different rates measuring pressure at the bottom of the well to characterize the losses in the fracture and the wellbore entry.

Figure 8:
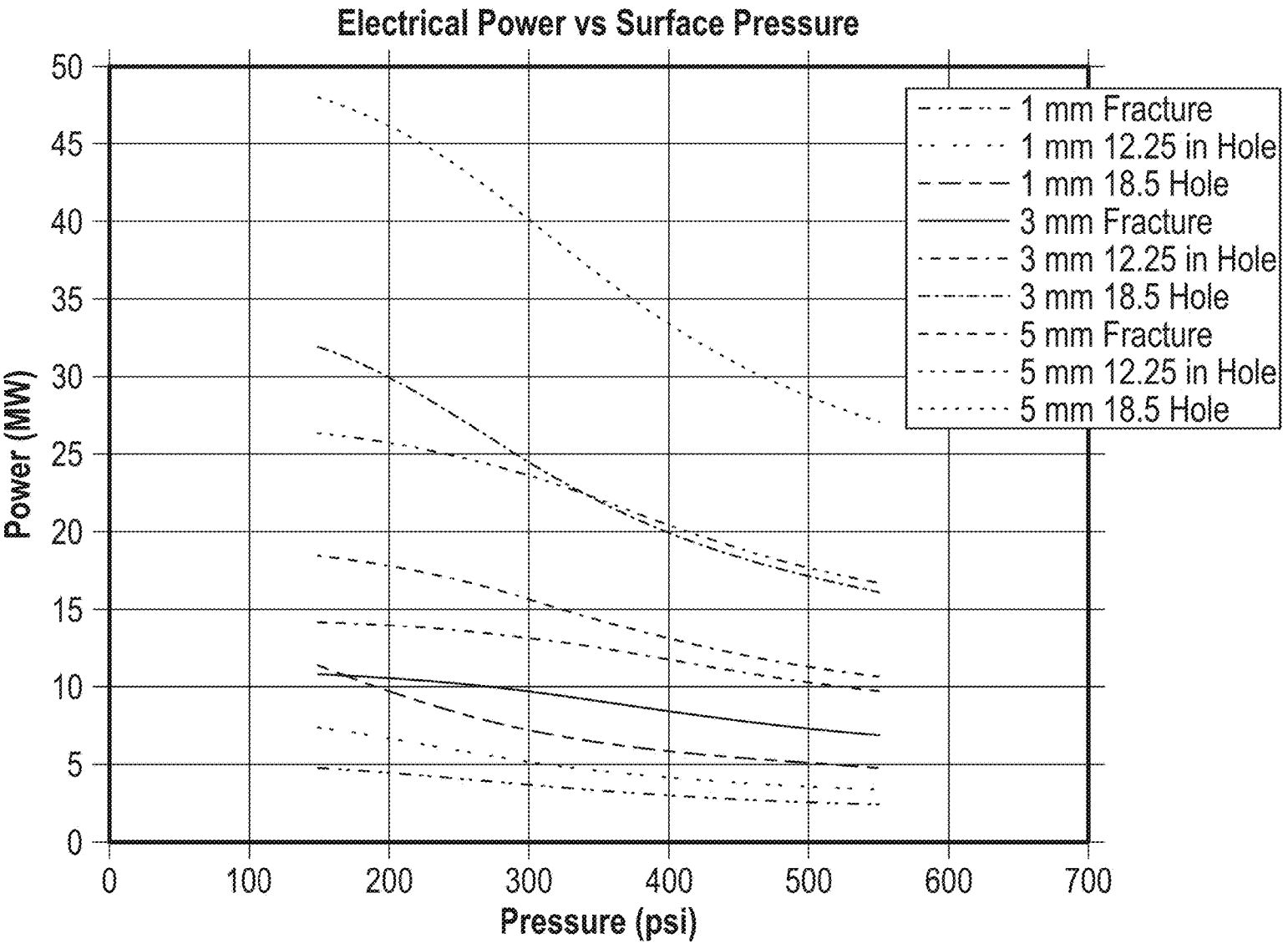
FIG. 8 depicts plots of available power extracted from a conventional geothermal reservoir with varying fracture aperture size in the range of 1 mm, 3 mm and 5 mm and varying wellbore diameter of 8.5 inches, 12.25 inches, and 18.5 inches.

FIG. 8 includes plots of available power extracted from a conventional geothermal reservoir with varying fracture aperture size in the range of 1 mm, 3 mm and 5 mm and varying wellbore diameters of 8.5 inches, 12.25 inches, and 18.5 inches. The plots of FIG. 8 are derived from simulations similar to those described above for FIG. 7. Note that generally an increase in fracture aperture size from 1 mm to 3 mm results in an increase in performance, and an increase in fracture aperture size from 3 mm to 5 mm results in a further increase in performance.

Figure 9:
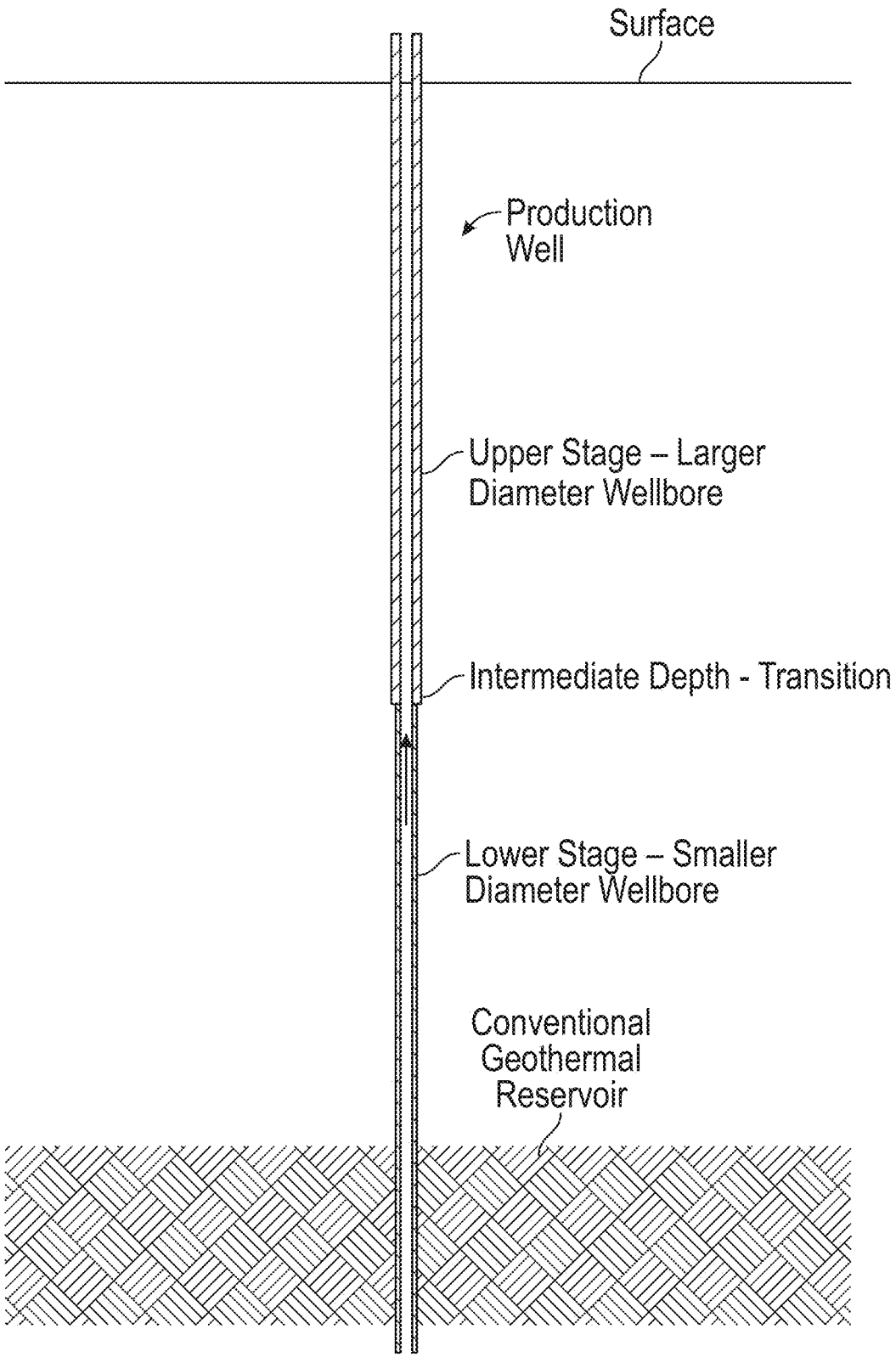
FIG. 9 depicts an example production well that intersects a conventional geothermal reservoir where the production well is drilled in two stages, referred to herein as an upper stage and a lower stage. In the upper stage, a larger diameter wellbore is drilled from the surface (or near the surface) to an intermediate depth. In the lower stage, a smaller diameter wellbore is drilled below the intermediate depth such that the smaller diameter wellbore of the lower stage extends below the larger diameter wellbore of the upper stage to the conventional geothermal reservoir.

In another aspect, the performance of a geothermal system can also be improved by drilling the production well that intersects a conventional geothermal reservoir in two stages, referred to herein as an upper stage and a lower stage. In the upper stage, a larger diameter wellbore (e.g., 12.5 inches in diameter) is drilled from the surface (or near the surface) to an intermediate depth. In the lower stage, a smaller diameter wellbore (e.g., 8.5 inches in diameter) is drilled below the intermediate depth such that the smaller diameter wellbore of the lower stage extends below the larger diameter wellbore of the upper stage to the conventional geothermal reservoir as shown in FIG. 9. The intermediate depth can be selected to balance the benefits versus risks and costs. The lower stage wellbore can be completed with a perforated casing or perforated liner as an open wellbore at least in the interval(s) that intersects the one or more naturally-occurring fractures of the conventional geothermal reservoir. The naturally-occurring fracture(s) carries a flow of pressurized hot water or brine into the lower stage of the production well. This architecture can also be used to access a non-conventional geothermal reservoir that provides a source of pressurized hot fluid that flows into the lower stage of the production well.

Figure 10:
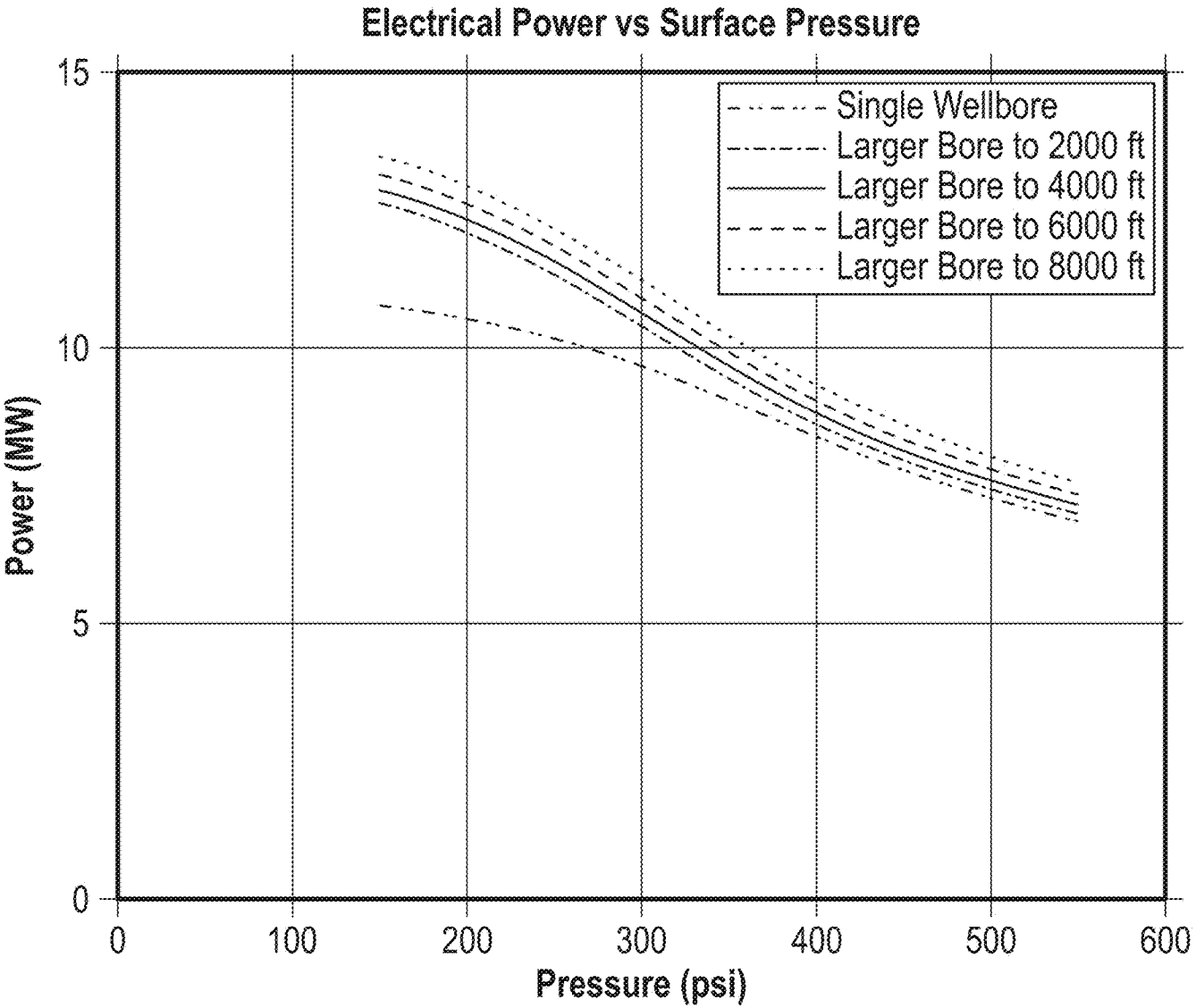
FIG. 10 depicts plots of available power extracted from a conventional geothermal reservoir with a production well having a single diameter of 8.5 inches as well as production wells having two-stage diameters of 12.5 inches and 8.5 inches with varying depths for the transition between stages ranging from 2000, 4000, 6000, and 8000 feet.

FIG. 10 includes plots of available power extracted from a conventional geothermal reservoir with a production well having a single diameter of 8.5 inches as well as production well having two-stage diameters of 12.5 inches and 8.5 inches with varying depths for the transition between stages ranging from 2000, 4000, 6000, and 8000 feet. The plots of FIG. 10 are derived from simulations similar to those described above for FIG. 7. In this case, the production well has a larger diameter closer to the surface, so the fluid flows into the larger pipe. Note that the production well of two-stage diameters results in an increase in performance relative to the single diameter wellbore. Furthermore, moving the transition between stages downward from 2000 feet to 4000 feet to 6000 feet to 8000 feet can provide incremental increases in performance.

Figure 11:
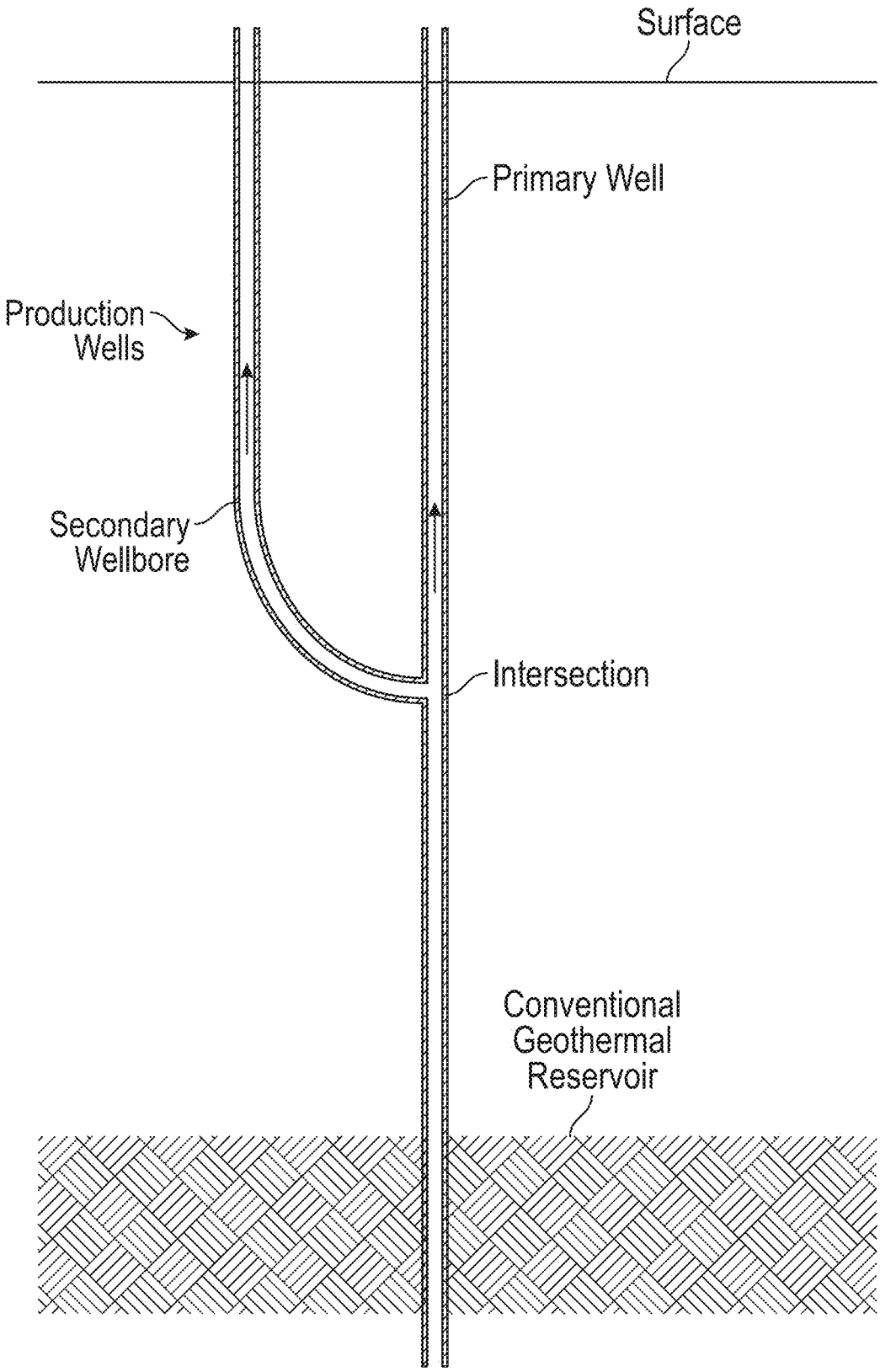
FIG. 11 depicts an embodiment for a geothermal system where a secondary production well is drilled to intersect an existing production well above a conventional geothermal reservoir.

In yet another aspect, for the case where an existing production well has been drilled, a secondary production well can be drilled to intersect the existing production well above a conventional geothermal reservoir as shown in FIG. 11. In this case, the existing production well is labeled as a primary well and the fluid flows from the conventional geothermal reservoir up the primary well to the point of intersection, and then flows up both the primary and secondary wells from that point as indicated by arrows in FIG. 11. The primary well can be completed with a perforated casing or perforated liner as an open wellbore at least in the interval(s) that intersect the one or more naturally-occurring fractures of the conventional geothermal reservoir. The naturally-occurring fracture(s) carries a flow of pressurized hot water or brine into the production well below the point of intersection of the primary and secondary production wells. This architecture can also be used to access a non-conventional geothermal reservoir that provides a source of pressurized hot fluid that flows into the primary production well below the point of intersection of the primary and secondary production wells.

Figure 12:
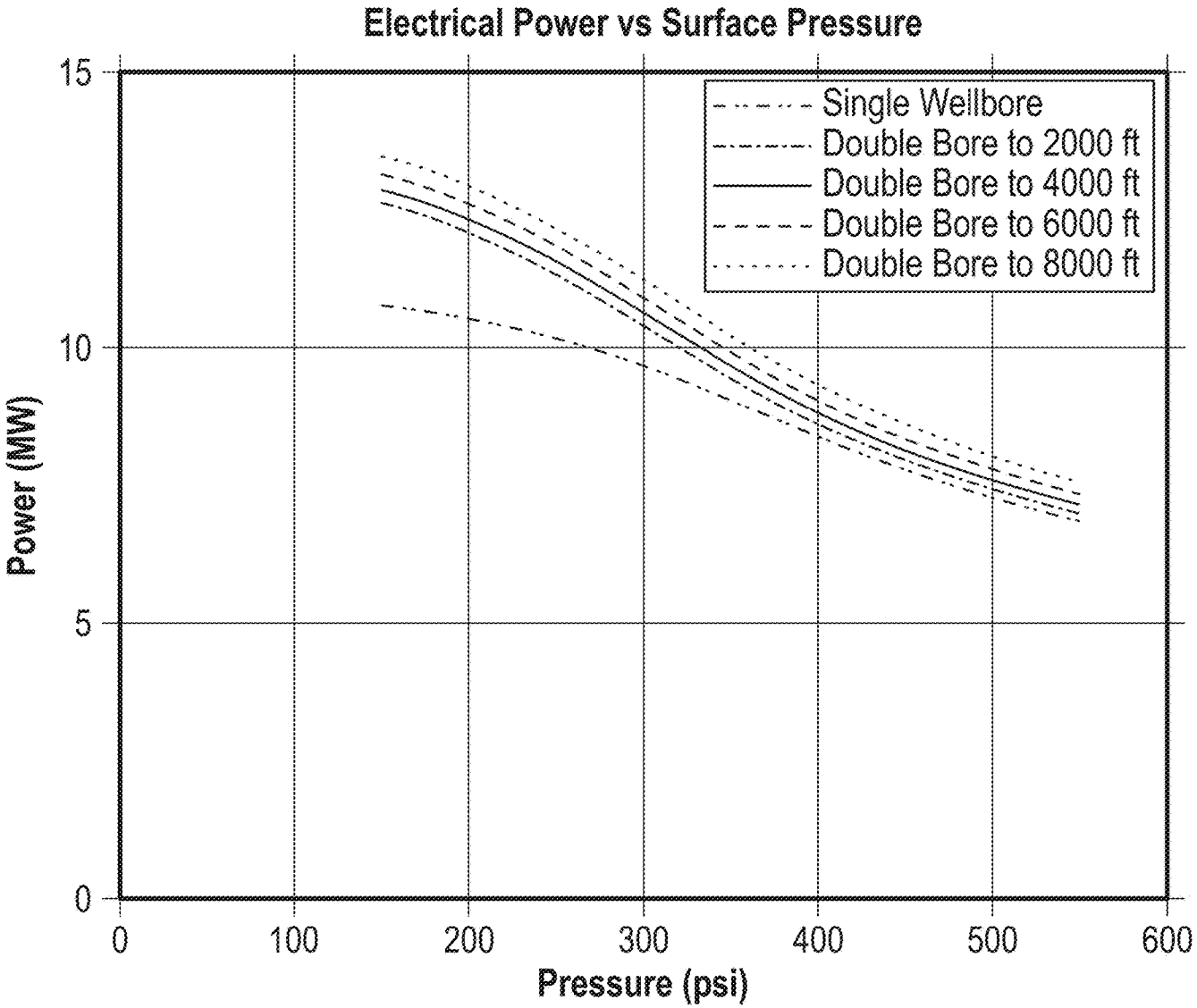
FIG. 12 depicts plots of available power extracted from a conventional geothermal reservoir with a single production well having a diameter of 8.5 inches as well as a system with a primary production well having a diameter of 8.5 inches that extends to the conventional geothermal reservoir together with a secondary production well having a diameter of 8.5 inches that intersects the primary production well above the conventional geothermal reservoir at varying depths ranging from 2000, 4000, 6000, and 8000 feet.

FIG. 12 includes plots of available power extracted from a conventional geothermal reservoir with a single production well having a diameter of 8.5 inches as well as a system with a primary production well having a diameter of 8.5 inches that extends to the conventional geothermal reservoir together with a secondary production well having a diameter of 8.5 inches that intersects the primary production well above the conventional geothermal reservoir at varying depths ranging from 2000, 4000, 6000, and 8000 feet. The plots of FIG. 12 are derived from simulations similar to those described above for FIG. 7. In this case, the secondary production well intersects with the primary production well to allow a larger flow area to the surface. Note that the system with the primary and secondary production wells results in an increase in performance relative to the single production well. Furthermore, moving the depth of intersection of the secondary production well and the primary production well downward from 2000 feet to 4000 feet to 6000 feet to 8000 feet can provide incremental increases in performance.

In still other embodiments, a two-stage production well or combination primary production well and secondary production well can be used in conjunction with methods for enlarging the aperture size of naturally-occurring fractures as described herein.

There have been described and illustrated herein several embodiments of geothermal systems and related methods used to capture and extract thermal energy (heat) from a geothermal reservoir. While particular configurations have been disclosed in reference to the geothermal systems and related methods, it will be appreciated that other configurations could be used as well. It will therefore be appreciated by those skilled in the art that yet other modifications could be made to the provided invention without deviating from its spirit and scope as claimed.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for extracting thermal energy from a conventional geothermal reservoir that includes a natural source of pressurized hot water or brine and at least one naturally-occurring fracture, the method comprising:

drilling or accessing a production well that intersects the conventional geothermal reservoir;

determining a position of a naturally-occurring fracture from well log data, wherein the naturally-occurring fracture carries a flow of the pressurized hot water or brine into the production well, the naturally-occurring fracture having a major width dimension and a minor height dimension, wherein the major width dimension of the naturally-occurring fracture is larger than the minor height dimension of the naturally-occurring fracture;

deploying a downhole tool in the production well, wherein the downhole tool has a tool body that supports at least one linear shaped charge having a major length dimension and a minor width dimension, wherein the major length dimension of the at least one linear shaped charge is larger than the minor width dimension of the at least one linear shaped charge, wherein the major length dimension of the at least one linear shaped charge is larger than the minor height dimension of the naturally-occurring fracture and the minor width dimension of the at least one linear shaped charge is smaller than the major width dimension of the naturally-occurring fracture;

aligning a position of the downhole tool in the production well to the position of the naturally-occurring fracture as determined from the well log data; and detonating the at least one linear shaped charge supported by the tool body to enlarge or open an aperture of the naturally-occurring fracture at an intersection of the naturally-occurring fracture and the production well, which reduces pressure loss of fluid flow into the production well from the naturally-occurring fracture, wherein the downhole tool is positioned with the major length dimension of the at least one linear shaped charge extending in a direction generally orthogonal to the minor height dimension of the naturally-occurring fracture and the minor width dimension of the at least one linear shaped charge extending parallel to the major width dimension of the naturally-occurring fracture, wherein:

the downhole tool has a central axis, and the at least one linear shaped charge is supported by the tool body of the downhole tool in an orientation generally parallel to the central axis of the downhole tool;

the at least one linear shaped charge comprises a continuous core of explosive material enclosed in an elongate seamless metal sheath housing having an inverted V-shape;

the elongate seamless metal sheath housing and the continuous core of explosive material produce a uniform linear cutting action upon detonation; and the tool body further supports a detonation control module operably coupled to the at least one linear shaped charge and remotely controllable from a surface to activate detonation of the at least one linear shaped charge.

2. The method according to claim 1, wherein:

a reduction in pressure loss increases fluid flow into the production well to increase an amount of captured heat.

3. The method according to claim 1, wherein:

detonating the at least one linear shaped charge increases size of the aperture of the naturally-occurring fracture at a wellbore surface.

4. The method according to claim 1, wherein:

the downhole tool is positioned in the production well to position and orient the at least one linear shaped charge such that penetration pattern of the at least one linear shaped charge that results from detonation intersects the naturally-occurring fracture.

5. The method according to claim 1, wherein:

the position of the downhole tool and the position of the naturally-occurring fracture are defined in a reference coordinate system.

6. The method according to claim 5, wherein:

the reference coordinate system includes well depth and azimuth angle.

7. The method according to claim 1, wherein:

the production well is configured to carry a flow of the pressurized hot water or brine through the production well for delivery to a wellbore surface.

8. The method according to claim 1, further comprising:

determining a position of at least one additional naturally-occurring fracture from well log data, wherein the at least one additional naturally-occurring fracture carries another flow of the pressurized hot water or brine into the production well;

aligning the position of the downhole tool in the production well to the position of the at least one additional naturally-occurring fracture as determined from the well log data; and detonating at least one additional linear shaped charge supported by the tool body to enlarge or open an aperture of the at least one additional naturally-occurring fracture at an intersection of the at least one additional naturally-occurring fracture and the production well, which reduces pressure loss of fluid flow into the production well from the at least one additional naturally-occurring fracture.

* * * * *